US006367582B1

(12) United States Patent
Derby

(10) Patent No.: US 6,367,582 B1
(45) Date of Patent: Apr. 9, 2002

(54) ADAPTABLE RESCUE HARNESS AND METHOD OF USE

(76) Inventor: Ronald C. Derby, P.O. Box 132132, Big Bear Lake, CA (US) 92315-8985

( * ) Notice: Subject to any disclaimer, the term of this patent is extended or adjusted under 35 U.S.C. 154(b) by 0 days.

(21) Appl. No.: 09/624,365

(22) Filed: Jul. 24, 2000

(51) Int. Cl.[7] ..... A47L 3/04

(52) U.S. Cl. ..... 182/3; 182/7; 119/857; 244/151

(58) Field of Search ..... 182/3, 4, 5, 6, 182/7, 8, 9, 65.1, 133, 134, 135, 136; 119/857; 244/151 R

(56) References Cited

U.S. PATENT DOCUMENTS 3,424,134 A * 1/1969 Rosenblum ..... 182/3
5,080,191 A * 1/1992 Sanchez ..... 182/3
5,131,490 A * 7/1992 Bell ..... 182/7
5,220,976 A * 6/1993 Gunter ..... 182/3
5,329,884 A * 7/1994 Bell ..... 182/3 X
5,348,035 A * 9/1994 Porter ..... 182/3 X
5,433,289 A * 7/1995 O'Rourke ..... 182/3
5,531,292 A * 7/1996 Bell ..... 182/3
5,878,833 A * 3/1999 Bell ..... 182/3
6,125,966 A * 10/2000 Jones ..... 182/3
6,178,652 B1 * 1/2001 Foster ..... 33/511

* cited by examiner

*Primary Examiner*—Bruce A. Lev
(74) *Attorney, Agent, or Firm*—Timothy Thut Tyson; Ted Masters; Freilich, Hornbaker & Rosen

(57) ABSTRACT

A harness (20) for suspending a rescuer (500) by a line (502) includes an upright attachment (22) so that the rescuer may be suspended in a substantially upright position, an inverted attachment (40) so that the rescuer (500) may be suspended in a substantially inverted position, a seated attachment (46) so that the rescuer (500) may be suspended in a substantially seated position, and a back attachment (50), so that the rescuer (500) may be suspended in an angled forward facing position. Harness (20) also includes a longitudinally adjustable back strap (52) so that the suspension angle of rescuer (500) may be altered, and two spaced longitudinally adjustable front straps (76) which limit the degree to which the rescuer (500) can lean backward when in the seated position.

3 Claims, 7 Drawing Sheets

20
500
34
34
28
31
32
26
32
36
36
22
30
24
21
58
42
51
52
42
50
8
86
86
6
92
92
4
90
90
2
54
88
56
88

ADAPTABLE RESCUE HARNESS AND METHOD OF USE

TECHNICAL FIELD

The present invention pertains generally to torso harnesses which are utilized by rescue personnel to perform rescue operations while suspended from a safety line, and in particular to a rescue harness which is designed for use with a helicopter, and can be adapted to meet different types of rescue situations.

BACKGROUND ART

Harnesses for supporting a person while the person is suspended from a safety line are well known in the art. These devices include various types of rescue harnesses, safety harnesses for window washers and tree trimmers, mountain climbing harnesses, and parachute harnesses. For example, U.S. Pat. No. 3,757,893 shows an articulating leg sling and belt. The leg slings and safety belt provide combined articulation permitting freedom of movement. The belt has offset fastening means which permit sliding movement along a portion of the belt adjacent The attachment point to a carabiner. U.S. Pat. No. 4,938,436 illustrates a safety harness and belt assembly for aircraft crew members. The device includes left and right slings, a first belt assembly having first and second ends, a survival kit strap attachment fitting which slidably engages the belt assembly, and a mechanism for realeasably attaching the fitting to a seat of the aircraft. The slings are designed to extend from the chest of the crew member over the crew member's shoulders, to the back of the crew member. U.S. Pat. No. 5,220,976 defines a safety harness to be worn by a worker, especially a worker wearing a plastic suit for protection in a radioactive or chemically hostile environment. The harness comprises a torso surrounding portion with at least one horizontal strap for adjustably securing the harness about the torso, two vertical shoulder straps with rings just forward of the peak of the shoulders for attaching a lifeline and a pair of adjustable leg supporting straps releasably attachable to the torso surrounding portion. U.S. Pat. No. 5,531,292 discloses a harness with adjustable means for supporting a tool belt. The harness is arranged to suspend a tool belt, and comprises a pair of leg straps, a pair of upper torso straps, a pair of rappelling straps, a seat strap, and four belt suspenders. Each of the upper torso straps includes a chest strap portion and a back strap portion, with the chest strap portions extending across respective portions of the chest of the worker. U.S. Pat. No. 5,878,833 illustrates a fall prevention and lowering system. The systems consists of a rope grab, a body engagement device such as a harness, and a lanyard and lowering device.

Harnesses used for helicopter rescues have seen little development over the years. Most harness styles were developed years ago for work on chimneys, buildings, and rock climbing. Helicopter rescue operators have merely bought these preexisting harnesses, attached them to their cables, and taken off. There are four primary harness types: (1) vertical body orientation, (2) horizontal body orientation, (3) inverted body orientation, and (4) seated body orientation. The harness for seated body orientation is the most frequently used for cliff rescues. Horizontal body orientation is used for swift water rescues. In each scenario, the occupant cannot land and must rely entirely on the helicopter to provided support. The harness for inverted body orientation is used for descending narrow openings such as caves, elevator shafts, and holes. This scenario would be utilized by ground units such as urban search and rescues (U.S.A.R.).

In order to save weight and space, usually only one harness is carried on a helicopter at a time. This one harness is selected at the airport and is put on prior to take off. If the helicopter is out on a call, and another call comes in requiring the use of a different type of harness, the helicopter must return to the airport, drop off the first harness, and pick up the second harness, or alternatively, if available, a second helicopter with another rescue crew must be dispatched.

A harness that could be used for a variety of situations would therefore provide an advantage over the prior art harnesses.

DISCLOSURE OF INVENTION

The harness of the present invention includes means for orienting the rescuer in any of the vertical, horizontal, inverted, or even seated positions. Therefore only one harness type is required, and additional trips to the airport are thereby avoided. Also, the harness of the present invention is adjustable so that it may be effectively worn by various size individuals. It is primarily an adaptable rescue harness which is worn by rescue personnel to perform a variety of different rescue operations. The harness allows the rescuer to be suspended from the end of a line, and lowered by helicopter, crane, hoist, or hand to the rescue site. The harness includes attachment points for the line which permit the rescuer to be suspended in a variety of orientations. A preferred name for the present invention is "THE RUSH". The name is an acronym derived from:

R for rappel, a technique used in mountain rescues;

U for USAR, which is an acronym for urban search and rescues;

S for swift water rescues; and,

H for helicopter used in cliff rescues and any hoist operation.

In accordance with a preferred embodiment of the invention, a rescue harness for suspending a rescuer by a line, includes (1) an upright attachment, so the rescuer may be suspended in a substantially upright position, (2) an inverted attachment, so the rescuer may be suspended in a substantially inverted position, (3) a seated attachment, so the rescuer may be suspended in a substantially seated position, and (4) a back attachment, so the rescuer may be suspended in an angled forward facing position.

In accordance with an important aspect of the invention, the back attachment includes a longitudinally adjustable back strap which permits the forward facing suspension angle to be adjusted from substantially vertical to substantially horizontal.

In accordance with an important feature of the invention, two spaced longitudinally adjustable front straps limit the backward travel of the rescuer when in a seated position.

In accordance with another important aspect of the invention, two spaced chest connectors are provided for removably receiving a capture strap.

In accordance with another important feature of the invention, two longitudinally adjustable buttock straps allow the harness to be securely fitted around the buttocks of the rescuer.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
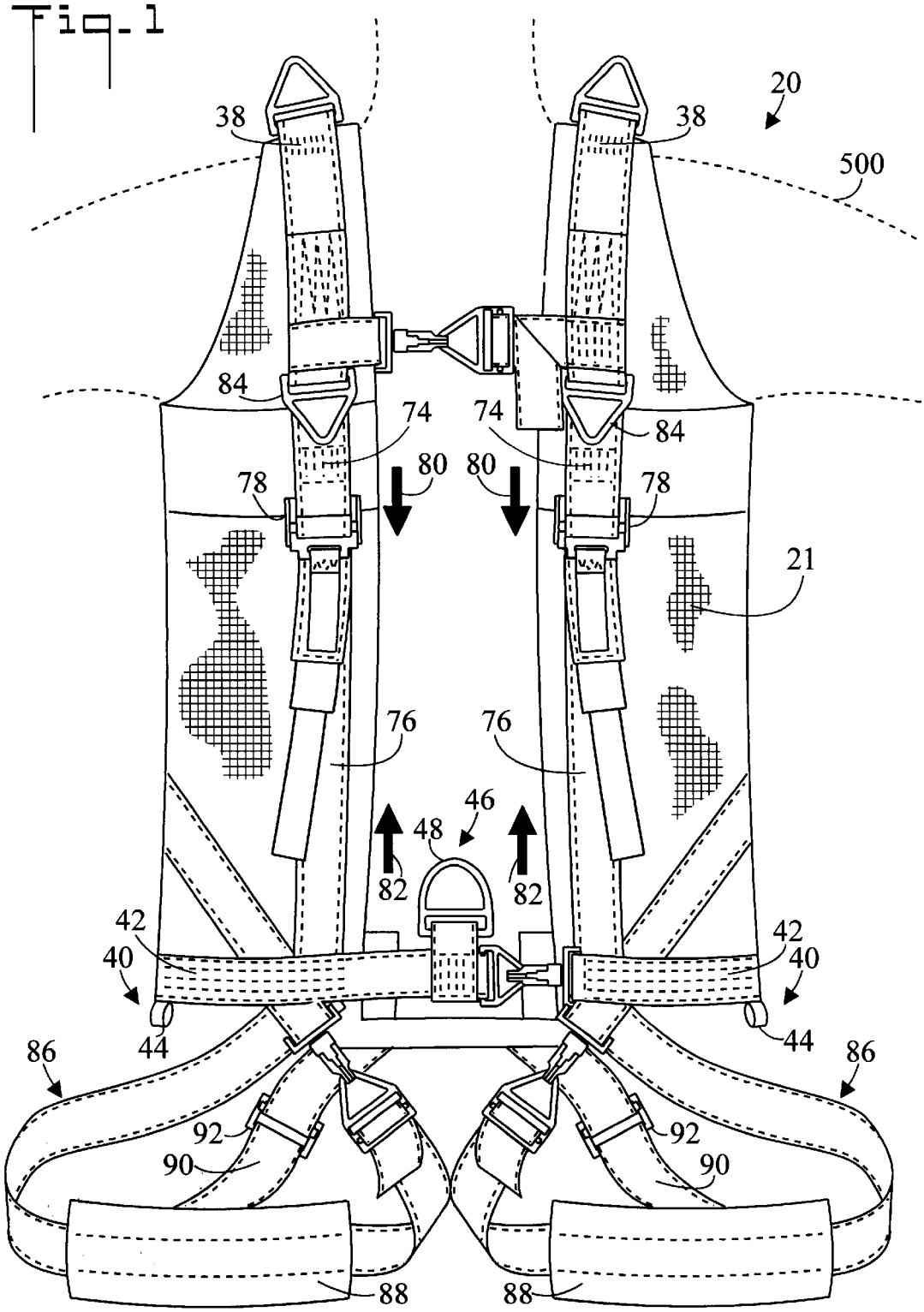
FIG. 1 is a front elevation view of a harness for suspending a rescuer by a line, in accordance with present invention.
Figure 2:
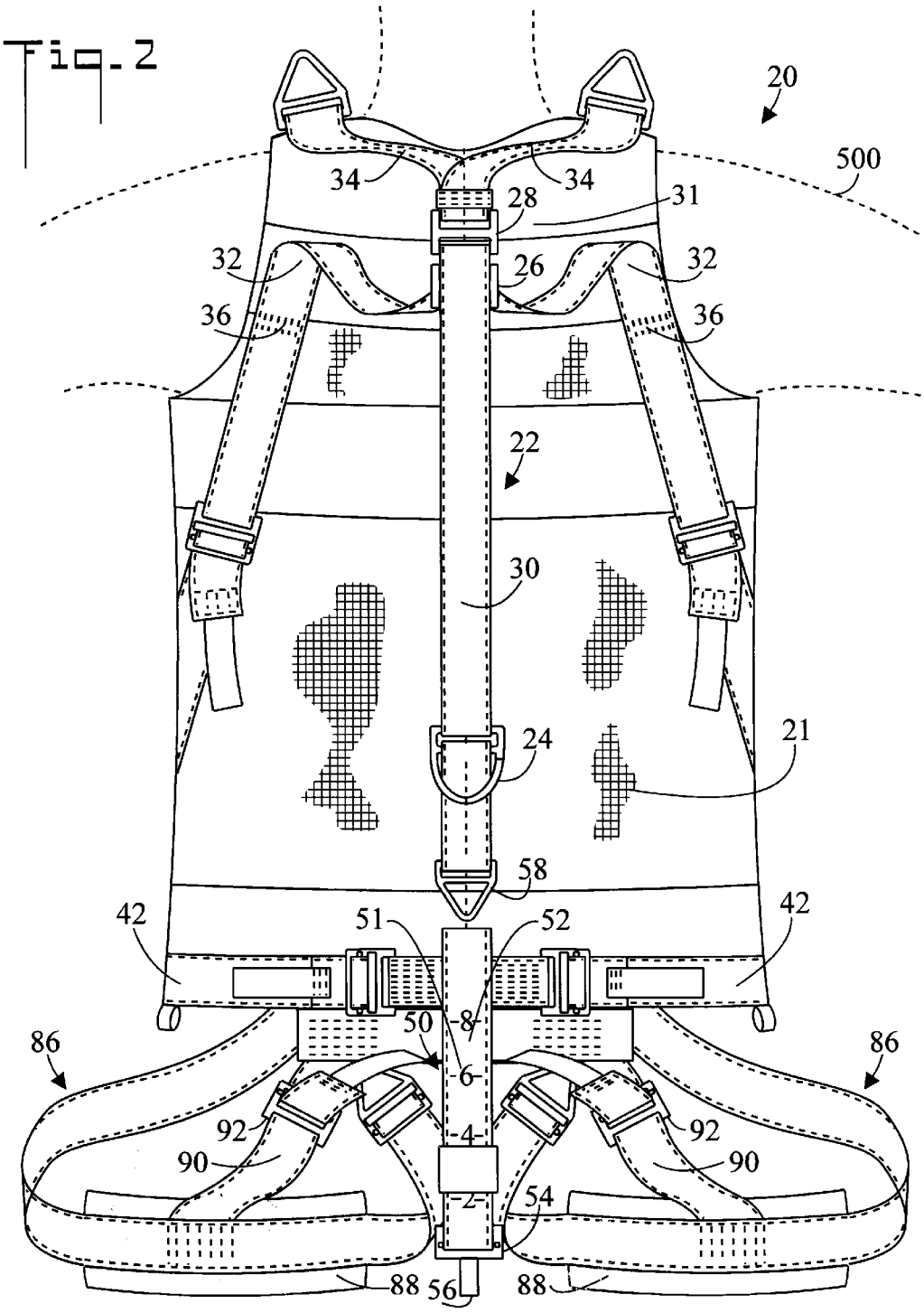
FIG. 2 is a rear elevation view showing the back of the harness.
Figure 3:
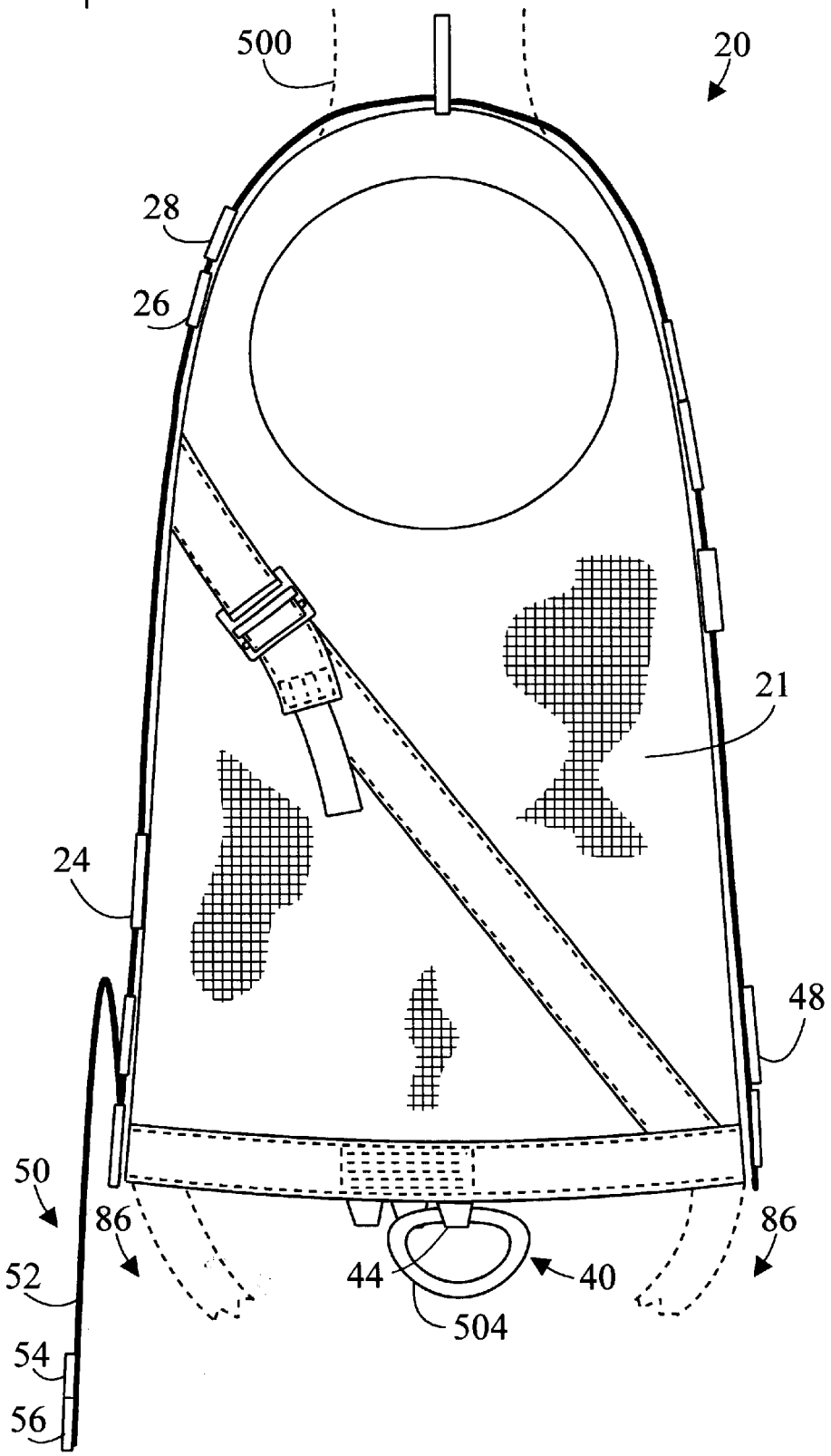
FIG. 3 is a side elevation view of the harness.

Referring initially to FIGS. 1–3, there are illustrated front elevation, rear elevation, and side elevation views respectively of a harness for suspending a rescuer by a line in accordance with the present invention, generally designated as 20. Harness 20 includes a torso covering vest like garment 21 which is worn by a rescuer 500 when performing rescue operations. Harness 20 can be put on like a coat without the necessity of the rescuer 500 stepping through leg straps. A variety of connectors and buckles (typically fabricated from metal), and straps (fashioned from a strong fabric) are attached to vest like garment 21 to form harness 20. The interconnected network of straps, connectors, and buckles supports the weight of the rescuer and the person being rescued. The fabric of the vest keeps the harness from getting tangled and facilitates donning. Harness 20 is securely fastened to the torso of the rescuer 500, and the rescuer 500 is then suspended from a line 502 (refer to FIGS. 4–15), such as a rope or cable to effect the rescue. Typically, the line 502 is supported by a helicopter, a crane, a hoist, or some other support means and the rescuer 500 is lowered to the rescue site. Harness 20 includes means for suspending the rescuer 500 in any one of four rescue positions. Harness 20 has an upright attachment 22 (refer to FIG. 2) for line 502, so that rescuer 500 may be suspended in a substantially upright position (also refer to FIG. 4). In a preferred embodiment, upright attachment 22 includes connectors 24, 26, and 28, and straps 30, 32 and 34. Upright connector 24, which connects to line 502 via a carabiner 504, is connected to connectors 26 and 28 via strap 30. Connectors 26 and 28 are in turn connected to the upper back portion 31 of vest like garment 21 via straps 32 and 34, respectively. Straps 32 and 34 are stitched to vest like garment 21 at points 36 and 38 respectively (refer also to FIG. 1). Connector 24 and strap 30 may also be utilized to tether the rescuer into a helicopter.

Figure 5:
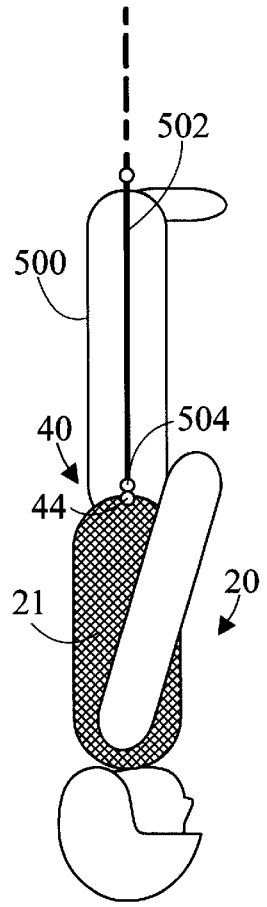
FIG. 5 is a side elevation view of a rescuer suspended in a substantially inverted position.

Harness 20 includes an inverted attachment 40 for line 502, so that rescuer 500 may be suspended in a substantially inverted position (also refer to FIG. 5). Harness 20 includes a waist belt 42. In a preferred embodiment, inverted attachment 40 includes two spaced side connectors 44 disposed on opposite sides of waist belt 42, so that they are approximately adjacent to the hips of the rescuer 500. Each side connector 44 is a loop which is shaped and dimensioned to receive a carabiner 504 which is attached to the end of line 502.

Figure 6:
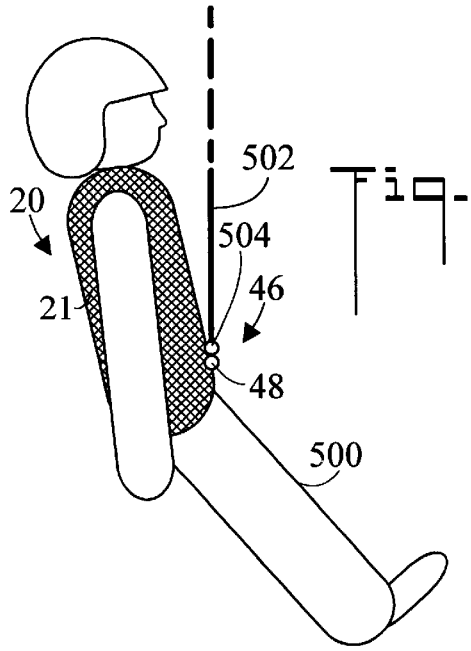
FIG. 6 is a side elevation view of a rescuer suspended in a substantially seated position.

Harness 20 includes a seated attachment 46 (refer to FIG. 1) for the line 502, so that rescuer 500 may be suspended in a substantially seated position (also refer to FIG. 6). In a preferred embodiment, seated attachment 46 includes a front connector 48 connected to the front center of waist belt 42. Front connector 48 is shaped and dimensioned to receive a carabiner 504 or hook which is attached to the end of line 502.

Harness 20 includes a back attachment 50 for line 502, so that rescuer 500 may be suspended in an angled forward facing position. As defined herein, "an angled forward facing position" means a "peter pan type flying position" wherein the body of the rescuer forms an acute angle with the vertical (refer to FIGS. 8–10). This position is particularly useful in performing fast water rescues, wherein the rescuer 500 is positioned downstream of the person to be rescued, and the person then drifts into the arms of the rescuer 500. In a preferred embodiment, back attachment 50 includes a longitudinally adjustable back strap 52 which may be removably connected between waist belt 42 and upper back portion 31 of vest like garment 21. One end of longitudinally adjustable back strap 52 is permanently connected to waist belt 42 via stitching. A back strap buckle 54 is connected near the opposite end of longitudinally adjustable back strap 52, and permits longitudinal adjustment of back strap 52. A connector 56 removably connects longitudinally adjustable back strap 52 to a connector 58 which is attached to strap 30. Strap 30 is connected to vest like garment 21 as described in FIG. 1 above. Also, upright connector 24 connects to carabiner 504 and line 502.

Figure 4:
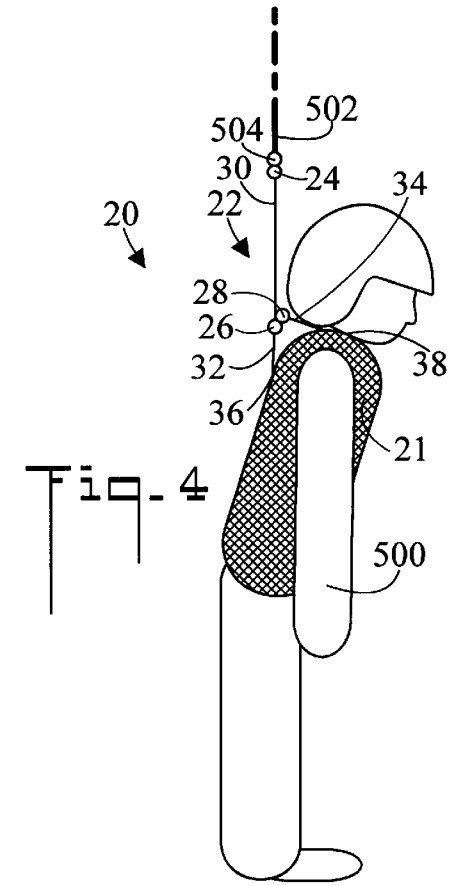
FIG. 4 is a side elevation view of a rescuer suspended from a line in a substantially upright position.

FIG. 4 is a side elevation view of a rescuer 500 suspended from a line 502 in a substantially upright position.

FIG. 5 is a side elevation view of a rescuer 500 suspended in a substantially inverted position.

FIG. 6 is a side elevation view of a rescuer 500 suspended in a substantially seated position.

Figure 7:
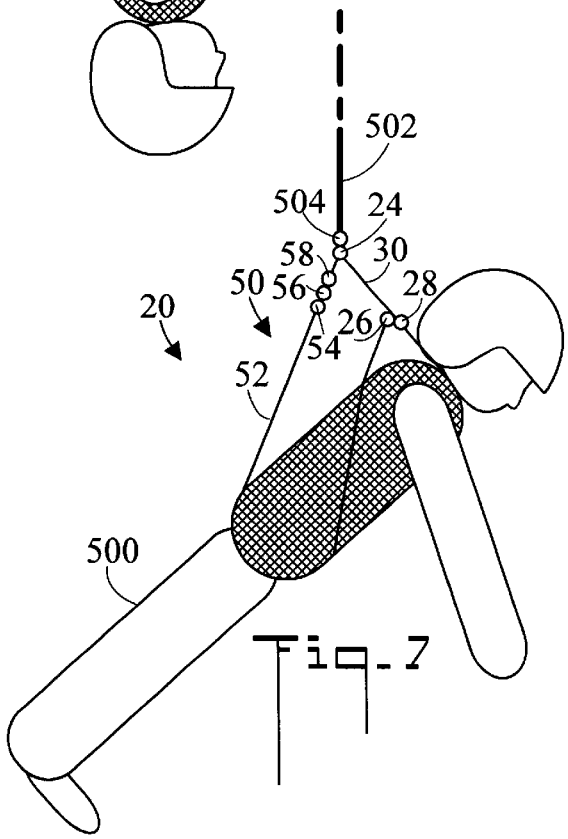
FIG. 7 is a side elevation view of a rescuer suspended in an angled forward facing position.

FIG. 7 is a side elevation view of a rescuer 500 suspended in an angled forward facing position.

Figure 8:
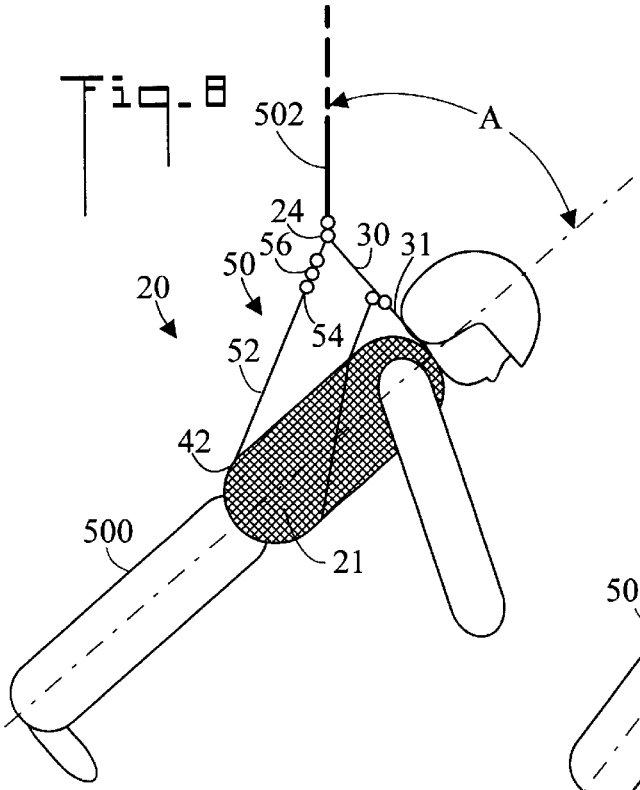
FIG. 8 is a side elevation view of a rescuer suspended in an angled forward facing position.

FIG. 8 is a side elevation view of a rescuer 500 suspended in an angled forward facing position. Harness 20 has a back attachment 50 for line 502, so that the rescuer 500 may be suspended in an angled forward facing position. Back attachment 50 includes a longitudinally adjustable back strap 52 one end of which is permanently connected via stitching to waist belt 42. The opposite end of longitudinally adjustable back strap 52 is connected to upright connector 24, and thence to line 502. In FIG. 8, longitudinally adjustable back strap 52 has been adjusted using buckle 54 so that the rescuer 500 forms a suspension angle A with the vertical (line 502).

Figure 9:
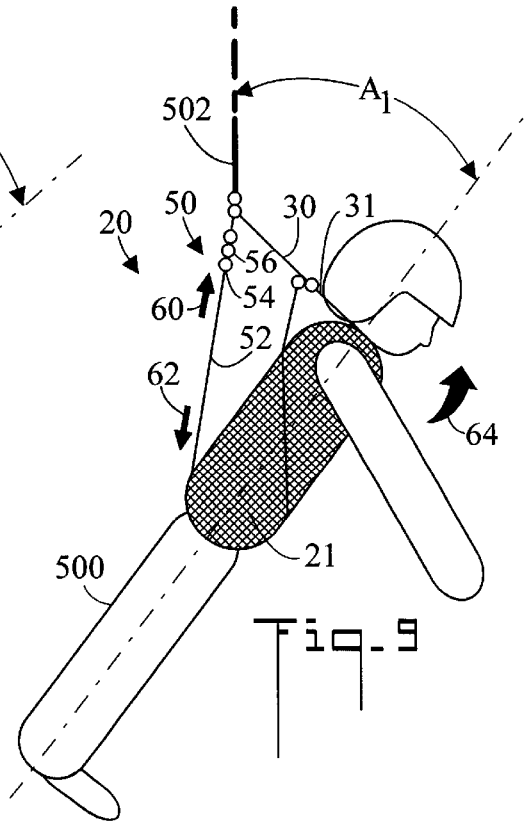
FIG. 9 is a side elevation view of a rescuer suspended in an angled forward facing position, showing a longitudinally adjustable back strap lengthened, thereby causing the rescuer to assume a more upright position.

FIG. 9 is a side elevation view of a rescuer 500 suspended in an angled forward facing position, showing longitudinally adjustable back strap 52 lengthened in directions 60 and 62, thereby causing rescuer 500 to rotate in direction 64 and assume a more upright position. That is, rescuer 500 forms an angle $A_1$ with the vertical, wherein angle $A_1$ is less than angle A of FIG. 8.

Figure 10:
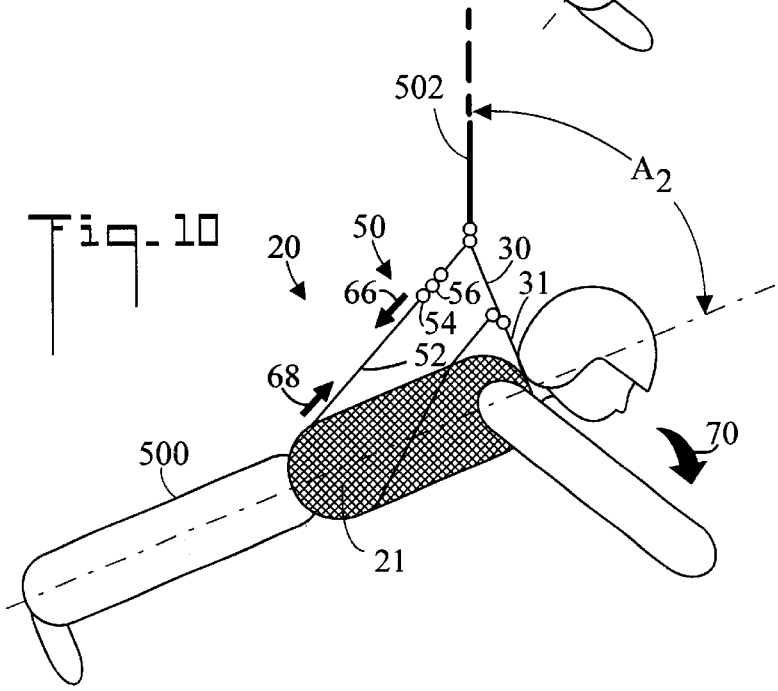
FIG. 10 is a side elevation view of a rescuer suspended in an angled forward facing position, showing the longitudinally adjustable back strap shortened, thereby causing the rescuer to assume a more horizontal position.

FIG. 10 is a side elevation view of a rescuer 500 suspended in an angled forward facing position, showing longitudinally adjustable back strap 52 shortened in directions 66 and 68, thereby causing rescuer 500 to rotate in direction 70 and assume a more horizontal position. That is, rescuer 500 forms an angle $A_2$ with the vertical, wherein angle $A_2$ is more than angle A of FIG. 8.

The angular adjustments shown in FIGS. 8–10 are useful in adjusting the angle of rescue, and also in adjusting harness 20 to accommodate the different centers of gravity for different sizes or builds of the rescuers 500. To serve as a guide in the adjustment process, longitudinally adjustable back strap 52 contains indicia 51 (FIG. 2) in the form of graduated length readings to assist in the length adjustment. Adjustment of back strap 52 to a predetermined length (as indicated by a predetermined graduated length reading) for a particular rescuer 500, produces a predetermined suspension angle when harness 20 is put on that particular rescuer 500 and that rescuer 500 is suspended from line 502.

Figure 11:
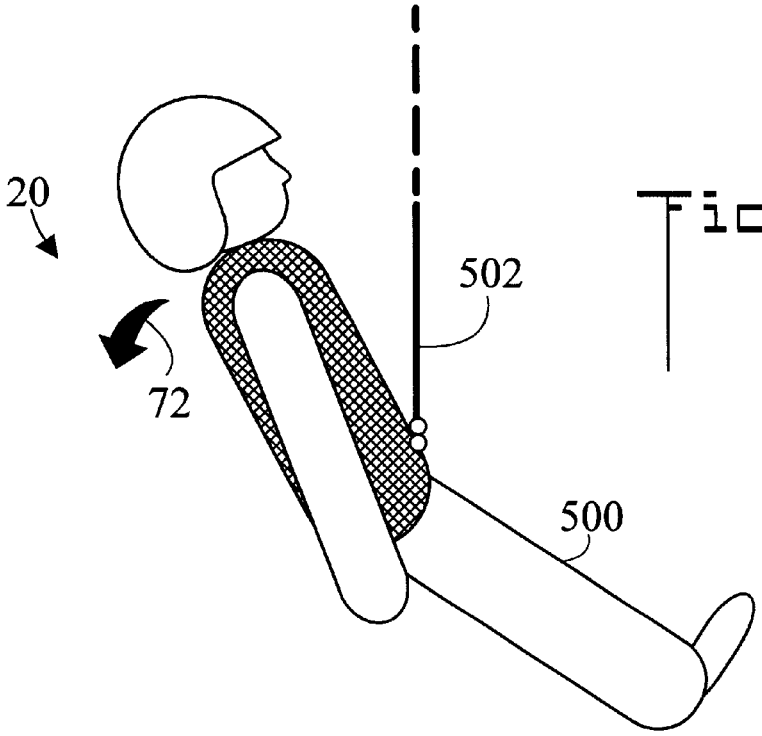
FIG. 11 is a side elevation view of a rescuer suspended in a seated position, wherein the rescuer can recline backward.

FIG. 11 is a side elevation view of a rescuer 500 suspended in a seated position, wherein the rescuer 500 can recline backward in direction 72. Also referring to FIG. 1, harness 20 has a top front portion 74 and a waist belt 42. Two spaced longitudinally adjustable front straps 76 are connected between top front portion 74 and waist belt 42. Two front buckles 78 permit the longitudinal adjustment of longitudinally adjustable front straps 76, so that longitudinally adjustable front straps 76 may be shortened in directions 80 and 82. By shortening longitudinally adjustable front straps 76, the ability to recline backward in direction 72 is limited, thereby preventing rescuer 500 from falling over backward.

Figure 12:
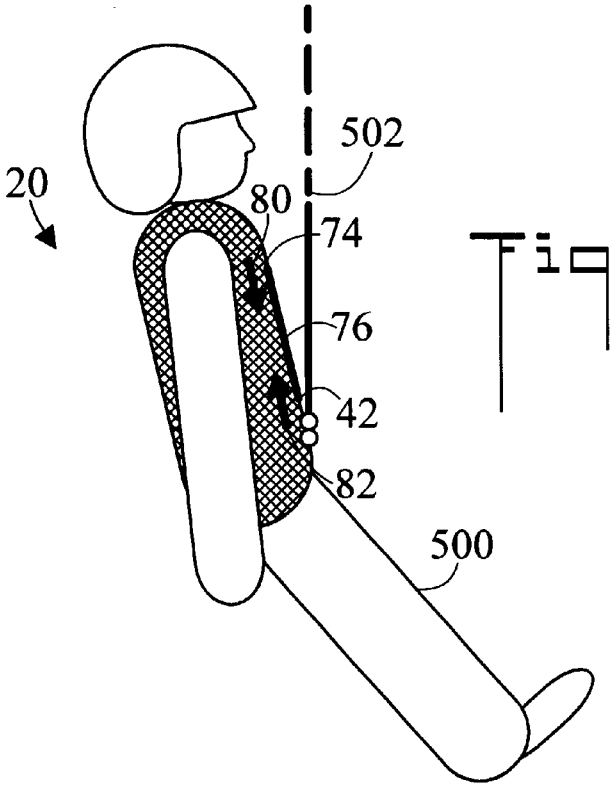
FIG. 12 is a side elevation view of a rescuer suspended in a seated position, wherein backward movement is restricted by shortening two spaced longitudinally adjustable front straps.

FIG. 12 is a side elevation view of a rescuer 500 suspended in a seated position, wherein backward movement is restricted by shortening the two spaced longitudinally adjustable front straps 76.

Figure 13:
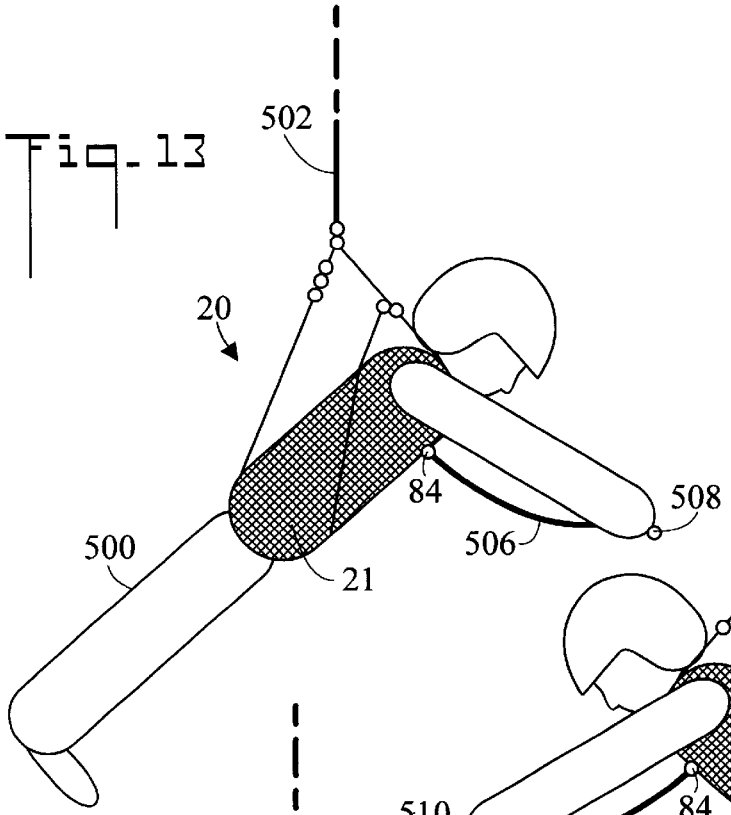
FIG. 13 is a side elevation view of a rescuer suspended in an angled forward facing position using a capture strap.
Figure 14:
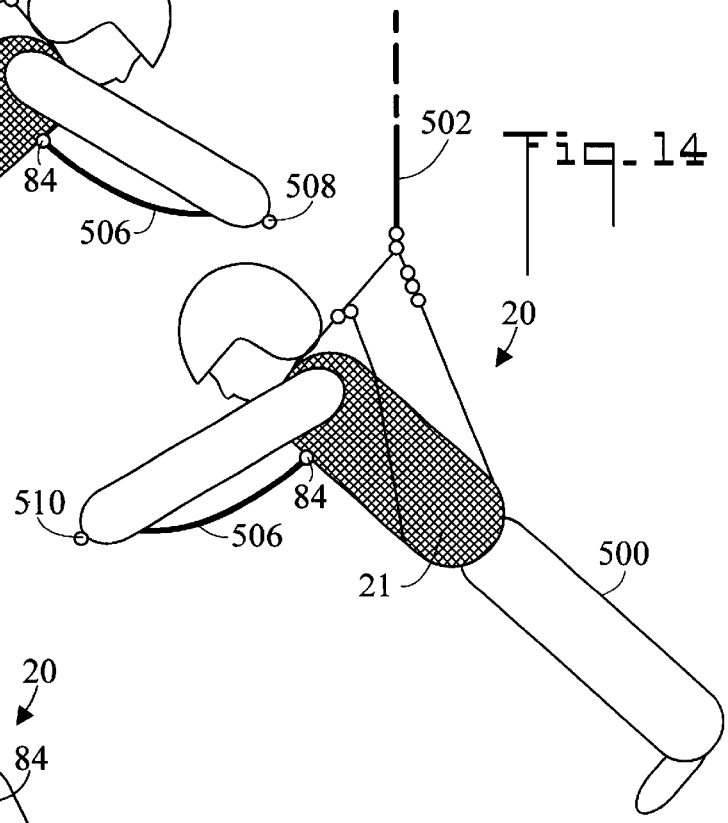
FIG. 14 is an opposite side elevation view of the rescuer suspend in an angled forward facing position using the capture strap; and, FIG. 15 is a front elevation view of the rescuer suspended in an angled forward facing position using the capture strap.
Figure 15:
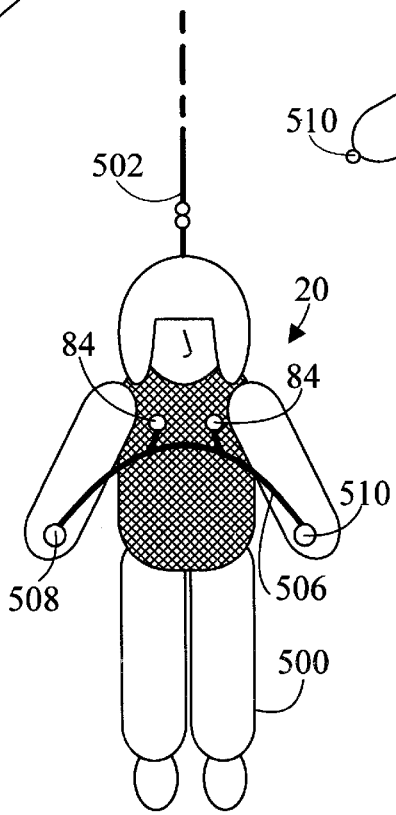

FIG. 13 is a side elevation view of a rescuer 500 suspended in an angled forward facing position using a capture strap 506. FIG. 14 is an opposite side elevation view of the rescuer 500 suspend in an angled forward facing position using the capture strap 506. And, FIG. 15 is a front elevation view of the rescuer 500 suspended in an angled forward facing position using the capture strap 506. Capture strap 506 is well known in the art, and comprises a strap having two removably connectable ends 508 and 510 which form a releasable metal to metal connection and which may be connected around the person being rescued. For example, connectable end 508 may be a metal loop, to which a snap type metal connectable end 510 is attached. Capture strap 506 is particularly useful in rapid water rescues. Also referring to FIG. 1, top front portion 74 of harness 20 includes two spaced chest connectors 84 for removably receiving capture strap 506. Spaced chest connectors 84 help to align capture strap 506 in a substantially horizontal position ready to receive the person to be rescued. In an alternative embodiment, capture strap 506 is included as a part of harness 20.

Again referring to FIGS. 1–3, harness 20 includes two adjustable leg straps 86 for encircling the legs of rescuer 500. Leg straps 86 are connected to the front and back of waist belt 42. Each leg strap 86 includes a thigh pad 88. A longitudinally adjustable buttock strap 90 is connected between the back of waist belt 42 and each thigh pad 88. A buttock buckle 92 allows buttock strap 90 to be adjusted to fit various rescuers 500

DESCRIPTION OF CONNECTORS AND BUCKLES

The following connectors and buckles utilized on harness 20 are available from United States Forgecraft Corp., of Fort Smith, Ark.:

- upright connector 24, P/N MS 22046-7, connects a strap to a carabiner;
- connector 26, P/N MS 22014-1, connects two straps together;
- connector 28, P/N MS 22014-1, connects two straps together;
- front connector 48, P/N MS 22046-7, connects the waist belt to a carabiner;
- back strap buckle 54, P/N 22043-1, adjusts the length of the adjustable back strap;
- connector 56, P/N 22043-1, is a snap type connector;
- connector 58, P/N 22045-1, connects a snap type connector to a strap;
- front buckle 78, P/N 22007-2, adjusts the length of the adjustable front strap;
- buttock buckle 92, P/N MS 70101, adjusts the length of the adjustable buttock strap; and,
- connectable end 510, P/N 3029-A, is a capture strap snap connector.

In a preferred embodiment, vest like garment 21 is fabricated of woven polyester having a vinyl coating such as Textilene sold by Ludlow Corporation of Exeter, N.H. The entire harness 20 is fabricated from nylon webbing Type VII, in accordance with MIL-W-4088H such as webbing having product code NWT7U available from Unitex Inc. of Los Angeles.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A harness for suspending a rescuer by a line, said harness comprising:

a waist belt and an upper back portion;

said harness having a back attachment for the line, so that the rescuer may be suspended in an angled forward facing position, said back attachment connected between said waist belt and said upper back portion;

said back attachment including a strap having one end connected to said upper back portion and a longitudinally adjustable back strap for adjusting a suspension angle of said angled forward facing position, said longitudinally adjustable back strap having one end permanently connected to said waist belt, and an opposite end which is removably connectable to said upper back portion via said strap;

said longitudinally adjustable back strap having a back strap buckle for adjusting the length thereof; and, said longitudinally adjustable back strap having indicia to serve as a guide in said length adjustment.

2. A method for suspending a rescuer by a line in an angled forward facing position, comprising:

(1) providing a harness having:

a waist belt and an upper back portion;

said harness having a back attachment for the line, so that the rescuer may be suspended in an angled forward facing position, said back attachment connected between said waist belt and said upper back portion;

said back attachment including a strap having one end connected to said upper back portion and a longitudinally adjustable back strap for adjusting a suspension angle of said angled forward facing position, said longitudinally adjustable back strap having one end permanently connected to said waist belt, and an opposite end which is removably connectable to said upper back portion via said strap;

said longitudinally adjustable back strap having a back strap buckle for adjusting the length thereof;

(2) adjusting said longitudinally adjustable back strap to a predetermined length so as to produce a desired said suspension angle;

(3) putting said harness on the rescuer; and, (4) suspending the rescuer from the line.

3. The method according to claim 2, further including:

said longitudinally adjustable back strap having indicia to serve as a guide in said length adjustment.

* * * * *